US011312605B2

(12) United States Patent
Thorne, Jr. et al.

(10) Patent No.: US 11,312,605 B2
(45) Date of Patent: Apr. 26, 2022

(54) BAGGED BOTTLE FILLING AND CAPPING DEVICES AND METHODS

(71) Applicant: Thorne Intellectual Property Holdings, LLC, Bountiful, UT (US)

(72) Inventors: Gale Harrison Thorne, Jr., Bountiful, UT (US); Gale Harrison Thorne, Bountiful, UT (US); Craig Newell Thorne, Salem, UT (US)

(73) Assignee: Thorne Intellectual Property Holdings, LLC, Bountiful, UT (US)

( * ) Notice: Subject to any disclaimer, the term of this patent is extended or adjusted under 35 U.S.C. 154(b) by 0 days.

(21) Appl. No.: 16/873,780

(22) Filed: Jul. 2, 2020

(65) Prior Publication Data

US 2022/0002133 A1 Jan. 6, 2022

(51) Int. Cl.

| | |
|---|---|
| ***B65B 5/06*** | (2006.01) |
| ***B65B 55/00*** | (2006.01) |
| ***B65B 3/04*** | (2006.01) |
| ***B67C 7/00*** | (2006.01) |
| ***B65D 1/36*** | (2006.01) |
| ***B67B 3/20*** | (2006.01) |

(52) U.S. Cl.

CPC ..... *B67C 7/00* (2013.01); *B65B 3/04* (2013.01); *B65B 5/068* (2013.01); *B65B 55/00* (2013.01); *B65D 1/36* (2013.01); *B67B 3/20* (2013.01)

(58) Field of Classification Search

CPC .. B67C 7/00; B67B 3/20; B65B 55/00; B65B 3/04; B65B 5/068; B65D 1/36

See application file for complete search history.

(56) References Cited

U.S. PATENT DOCUMENTS

| | | | | |
|---|---|---|---|---|
| 4,146,153 | A | 3/1979 | Bailea | |
| 5,342,121 | A * | 8/1994 | Koria | A61G 10/005 312/1 |
| 8,449,301 | B2 | 5/2013 | Thorne, Jr. et al. | |
| 8,449,521 | B2 * | 5/2013 | Thorne, Jr. | A61J 1/20 604/411 |
| 9,149,939 | B2 * | 10/2015 | Zambaux | B25J 21/02 |
| 9,636,444 | B2 | 5/2017 | Burbank et al. | |
| 10,555,872 | B1 * | 2/2020 | Thorne | A61J 1/2096 |
| 10,800,556 | B2 * | 10/2020 | Thorne | A61J 1/2086 |
| 10,940,087 | B2 * | 3/2021 | Thorne | B01L 1/04 |
| 2014/0034545 | A1 * | 2/2014 | Pawlowski | B65B 3/003 206/565 |
| 2016/0166760 | A1 * | 6/2016 | Orofino | A61M 5/002 604/416 |
| 2019/0030236 | A1 * | 1/2019 | Okihara | A61M 5/001 |

* cited by examiner

*Primary Examiner* — Thomas M Wittenschlaeger
*Assistant Examiner* — Katie L Gerth
(74) *Attorney, Agent, or Firm* — Gale H. Thorne

(57) ABSTRACT

Method and apparatus are disclosed for capping a plurality of bottles enclosed and sealed in a plastic bag. The method comprises disposing the plurality of bottles in a tray in a predetermined array such that caps, disposed in a plate can be displaced for convenient capping in a single step. Ratchet tools are disclosed for facile threading of caps to bottles.

8 Claims, 7 Drawing Sheets

BAGGED BOTTLE FILLING AND CAPPING DEVICES AND METHODS

FIELD OF INVENTION

This invention is related to methods and devices for capping threaded bottles, without direct digital engagement whereas caps and bottles are fully enclosed and sealed within a pliant cover, such as a plastic bag, and therefore unaccessible for unmediated finger contact with cap or bottle.

DESCRIPTION OF RELATED ART

In those product filling kits, where a plurality of bottles are kept and filled and capped within a sealed plastic bag to retain product sterility before the bag is breached for access to the so-filled bottles, the difficulty of accessing each cap and affixing it to a bottle is well known. Such capping is often challenging and time consuming, requiring special digital skills to be accomplished in a reasonable period of time. While plastic bags are generally pliant, the lack of a workable frictional interface between bottle cap exteriors and bag surfaces makes accessing and displacing parts across the bag exterior difficult.

BRIEF SUMMARY AND OBJECTS OF THE INVENTION

In brief summary, this novel invention substantially alleviates all of the known problems associated with current methods related to capping a plurality of bottles within a sealed plastic bag. The inventive method involves a plurality of novel steps and devices for accessing, displacing and securely affixing caps to bottles after bottle filling such that each bottle can be displaced from the bag into a polluted environment without contaminating bottle contents.

To accomplish such, the plurality of bottles are displaced into a pattern holding device, such as a tray, to provide a predetermined bottle configuration with bottle neck orifices disposed upward for bottle filling. A cap containment plate is configured with a set of holes which are in a pattern spaced to align caps with the bottle configuration. Each plate hole, within the cap pattern, is sized and shaped to frictionally retain a cap therein as the plate is displaced, but is permissive to cap rotation within the hole, a condition well understood and readily achievable by those skilled in product packaging art. A second set of holes in the plate, each hole having diametrical dimension which permits facile displacement about the neck of each bottle, is also provided in the same, but offset, pattern such that the plate can be displaced upon the bottles without obstructing access to the orifices. In this manner, the plate can be disposed in a first position where orifices are unobstructed for filling. Once the bottles are filled, the plate need only be displaced a short distance for each cap to be disposed over the neck of each associated bottle.

Depending upon bag pliancy, such plate displacement may also not be trivial. For this reason, attention is drawn to a spout used for dispensing product into the bottles. Such spouts are generally tapered and of known dimensions. And such a spout may be the only deployable part associated with bottle filling. For this reason, the step of displacing the plate is readily accomplished by providing yet another hole in the plate which provides a frictional interface between spout and plate such that when the spout is firmly displaced into the plate/spout hole, the plate can be moved into place by spout displacement. By this method, all of the caps are displaced above the bottle necks by a single action, eliminating the arduous task of moving the caps into place one by one.

If the bottles are capped via a threaded interface with the caps, each cap must be individually rotated for cap to bottle engagement. Keeping in mind that the spout and associated assembly is most often the only means for mechanical communication from outside the bag surface, turning and so-tightening each cap can also be challenging as the numbers of bottles to be capped grows. Also digitally twisting cap and bag with repeated steps to tighten each cap to a bottle is prone to difficulty. For these reasons, a ratchet tool designed for affixing cap to bottle with repeated short arc displacement provides a useful tool. However, accessing and using such a tool within and through the bag simply provides an additional undesired challenge. To ameliorate this problem, the ratchet tool is provided, within the scope of the instant invention, for selectively rotating each cap to be secured to an associated bottle. Further, the tool preferably has an attaching filter/spout (the only part which is affixed exteriorly for manual manipulation) interface. The interface permits the spout to be displaced therein and become affixed, such that the spout and associated assembly becomes a handle for the ratchet tool which can, then, readily be used to rotate each cap disposed in the plate above a bottle neck until that cap is secured to the bottle.

Accordingly, primary objects are to provide:

A plastic bag which is sufficiently pliant to permit filling of a plurality of bottles, disposed therein, via displacement of a spout assembly which provides the only access into the bag after the bag is sealed with bottles inside.

A bottle tray which securely holds each bottle upright in a predetermined pattern.

A cap plate which is designed to securely hold caps in a first hole array consistent with the predetermined pattern of the bottles and, yet, be permissive to impelled rotation of the caps within the holes.

The cap plate, also provides a second array of holes identical to the bottle array, each hole having a size which permits facile displacement about the neck of the bottle and ready access to an associated bottle filling orifice, the second array of holes being offset from the first array such that in one disposition access is provided to orifices for bottle filling and in the other disposition caps are disposed for bottle attachment.

A ratchet tool which comprises a cap interface whereby the cap is rotated in a direction which affixes cap to bottle and a second interface whereby the filter/spout and associated assembly are affixed to the ratchet tool to act as a handle for the tool.

Inventive steps for:

Displacing the cap plate such that each cap is disposed for capping an associated bottle;

Affixing a ratchet tool to a spout such that the spout and associated assembly can be used as a handle for the tool;

Rotating each cap for secure bottle/cap attachment using the spout-affixed ratchet tool.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate the segment of the device normally closest to the object of the sentence describing its position. The term distal refers to the other end. Reference is now made to the embodiments illustrated in FIGS. 1-17A wherein like numerals are used to designate like parts throughout. Parts numbered with primes indicate similar shape and function to part numbered without primes, but having selective, disclosed differences in shape or function or both.

Figure 1:
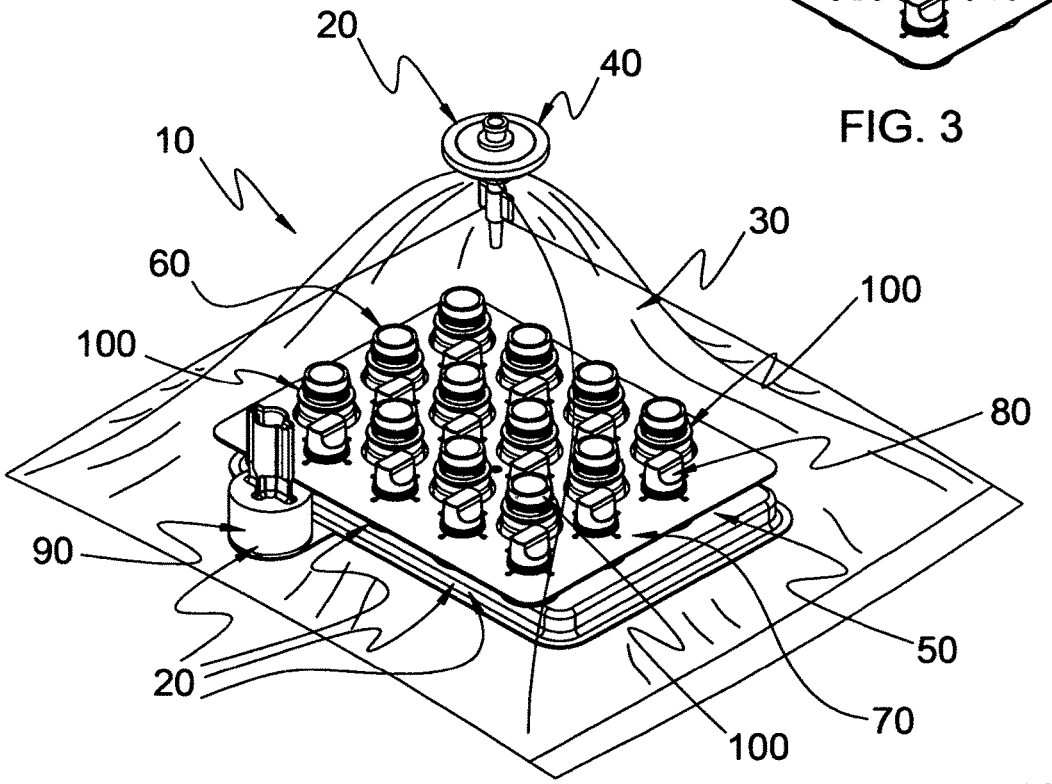
FIG. 1 is a perspective of a kit assembled according to the present invention.

Seen in FIG. 1 is an exemplary kit 10 assembled with items 20 disposed within a bag 30. Generally, bag 30 and items 20 are pre-sterilized and provided as convenience kit 10 for filling and capping bottles while maintaining a predetermined level of sterilization of a deliverable product. In this example, the items comprise a filter/spout assembly 40, a tray 50 which is designed to receive and securely hold bottles (generally referenced by the number 60) in a predetermined well pattern, a plate 70 which is designed to receive and hold caps (generally referenced by the number 80) in a similar, but, offset pattern to the well pattern, and a capping tool 90. Application of the present invention is not restricted to this example, but may be applied to other uses and patterns where capping is performed in a closed environment without direct digital contact. One who is skilled in the art of capping and in-bag filling and capping would understand an opportunity for an enlarged scope of uses without providing additional examples.

An example of a filter/spout assembly, similar to assembly 40, is disclosed in U.S. Pat. No. 10,555,872 B1, allowed Feb. 11, 2020 and titled CONVENIENCE KITS FOR ASEPTIC STERILIZATION AND DISPENSING (the PATENT). Such filter/spout assemblies provide a filtering pathway for all matter which is displaced into a bag, such as bag 30. As well, pliancy of bag 30 permits assembly 40 to be facilely displaced for bottle 60 filling as well as other functions disclosed in detail hereafter.

The PATENT provides an example of a tray which holds both caps and bottles. It should be noted that tray 50 only holds bottles, in the present invention caps are not disposed in the tray, providing opportunity for greater bottle capacity in a tray of smaller size.

Figure 2:
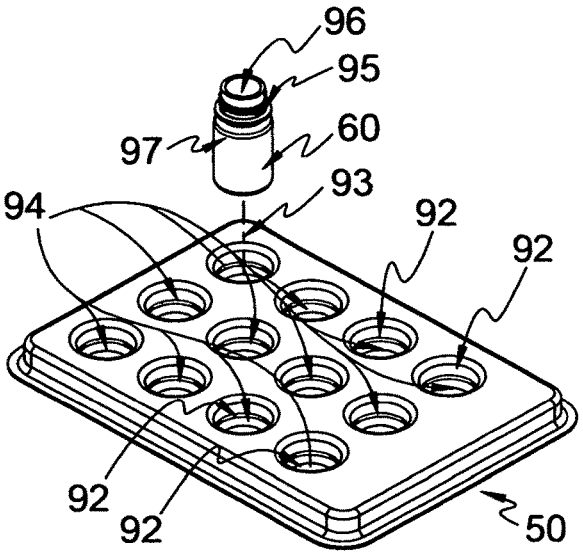
FIG. 2 is an exploded view of a tray and a single bottle to be displaced into a molded holding cup well of a plurality of wells in the tray.
Figure 2A:
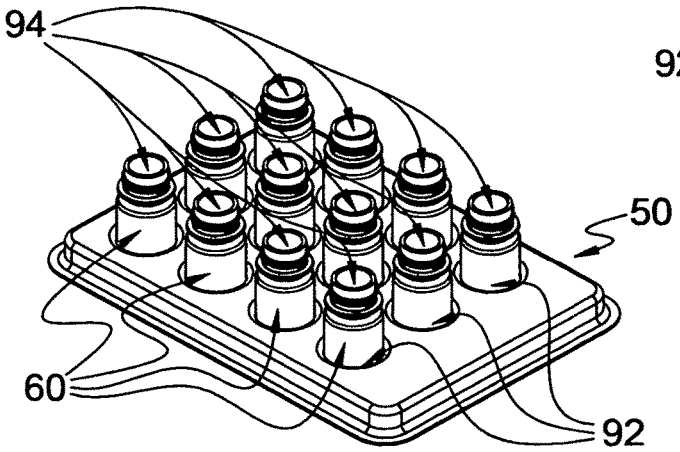
FIG. 2A is a perspective of the tray seen FIG. 2 with bottles disposed in each molded wall of the tray.

A bottle 60 is seen ready for displacement into a well 92 of tray 50 in FIG. 2, along dashed line 93. Each well (generally referenced by number 92) is sized and shaped to securely hold a bottle 60 in transport and while being capped. A fully filled tray 50, providing bottles 60 disposed in a predetermined array 94 is seen in FIG. 2A. Note, in FIG. 2, that the neck 95 of bottle 60, disposed about an open orifice 96, is generally reduced in diameter relative to the bottle 60 body 97.

Figure 3:
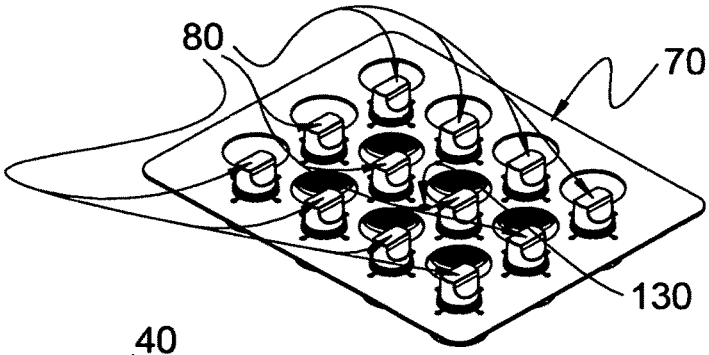
FIG. 3 is a top elevation of a plate designed to hold a plurality of caps.

Reference is made to FIG. 3 wherein a plate 70 is seen to comprise a pattern 98 of holes, generally referenced by number 100, each hole 100 being sized and shaped and disposed to be placed about a neck 95 of a bottle 60 (see FIG. 2) without catching or being retarded when plate 70 is disposed there about and lifted therefrom. Plate 70 also comprises another pattern 104 of holes 105, wherein bottle caps 80 are inserted as indicated by dashed line 106 in FIG. 3A.

Figure 3A:
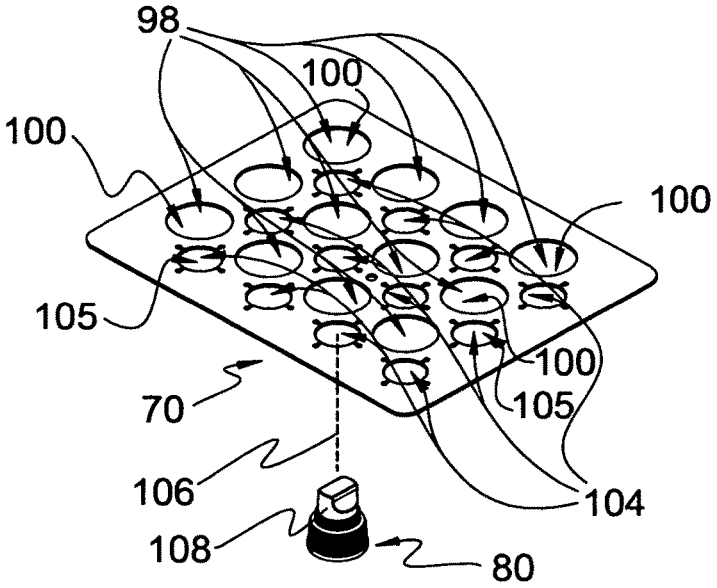
FIG. 3A is an exploded view of the plate seen in FIG. 3 and a cap for being displaced into and held in a hole in the plate.

As seen in FIG. 3A, each cap comprises a small diameter neck 108 about which an associated mounting hole 105, sized and shaped to hold cap 80 securely in plate 70 and yet permit the held cap 80 to be rotated for attachment to a bottle 60. As seen in FIG. 1, the pattern 98 (not referenced in FIG. 1) of holes 100 is offset to permit unobstructed bottle 60 filling.

Figure 1A:
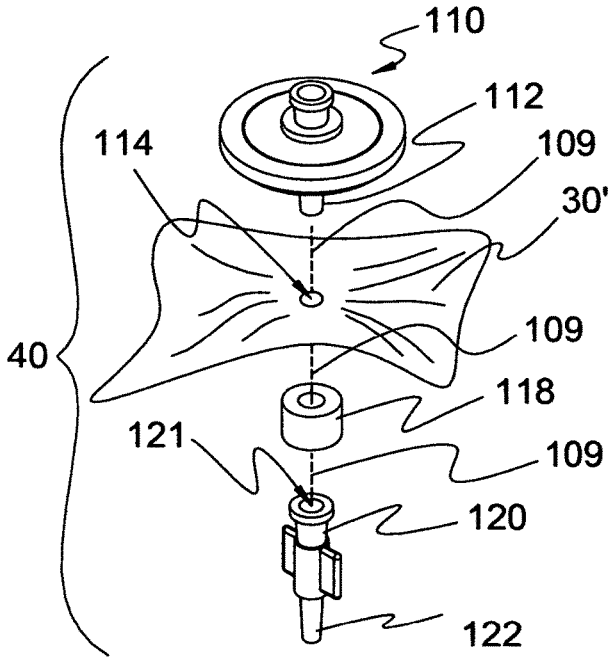
FIG. 1A is an exploded view of a filter/spout assembly seen in FIG. 1.
Figure 1B:
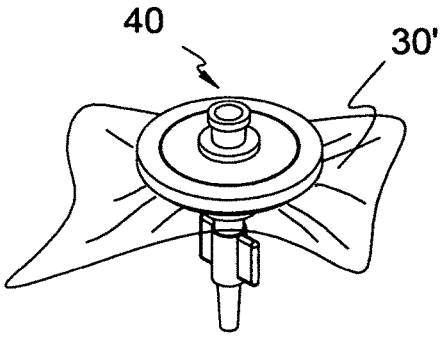
FIG. 1B is a perspective of an assembled filter/spout assembly.
Figure 4A:
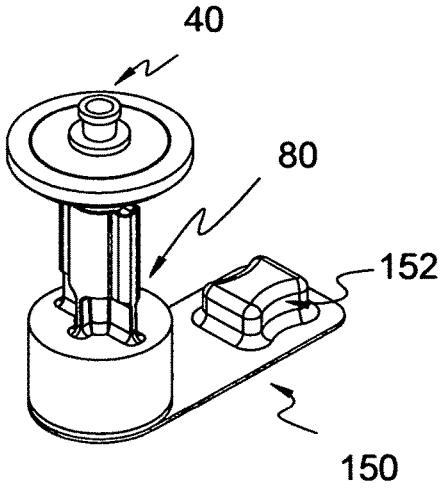
FIG. 4A is a perspective of the ratchet tool seen in FIG. 4 assembled and securely, but releasibly, disposed upon the holding fixture.

Regarding functions of filter/spout assembly 40, construction of assembly 40 can be accomplished, as indicated by dashed line 109, as seen in FIG. 1A. A sterilizing filter 110 comprises a distending hollow member 112 through which filtered matter passes into bag 30 (through a hole 114 in a section 30' of bag 30). A grommet 118 is disposed about member 112 to provide a seal about hole 114. A fitting 120 comprising a continuing flow path 121 and a tapered dispensing spout 122 is also affixed to member 112 to provide sealing force against grommet 118 and, thereby, assure the seal. A fully assembled filter/spout assembly 40 is seen in FIG. 1B.

Digitally acquiring and rotating caps to close each bottle, while both are protectively enclosed within a bag, such as bag 30, becomes more difficult and tiring as the number of bottles in array 94 increase. In the PATENT, only four bottles needed to be capped, but in a kit assembly having a much larger bottle 60 numbers, as seen in FIG. 2A, there is a need for a better way for displacing each cap to cover an associated bottle and for rotating and securely affixing caps to bottles.

Figure 5:
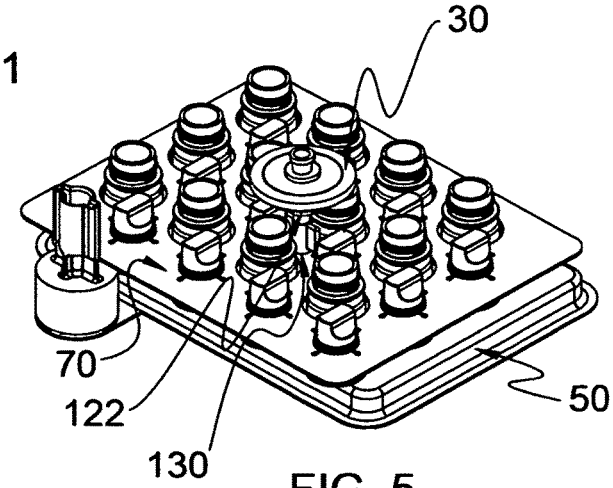
FIG. 5 is a perspective of parts of the kit seen in FIG. 1 with the bag removed from view for clarity of presentation, the filter spout assembly being disposed for packaging and transport.
Figure 3B:
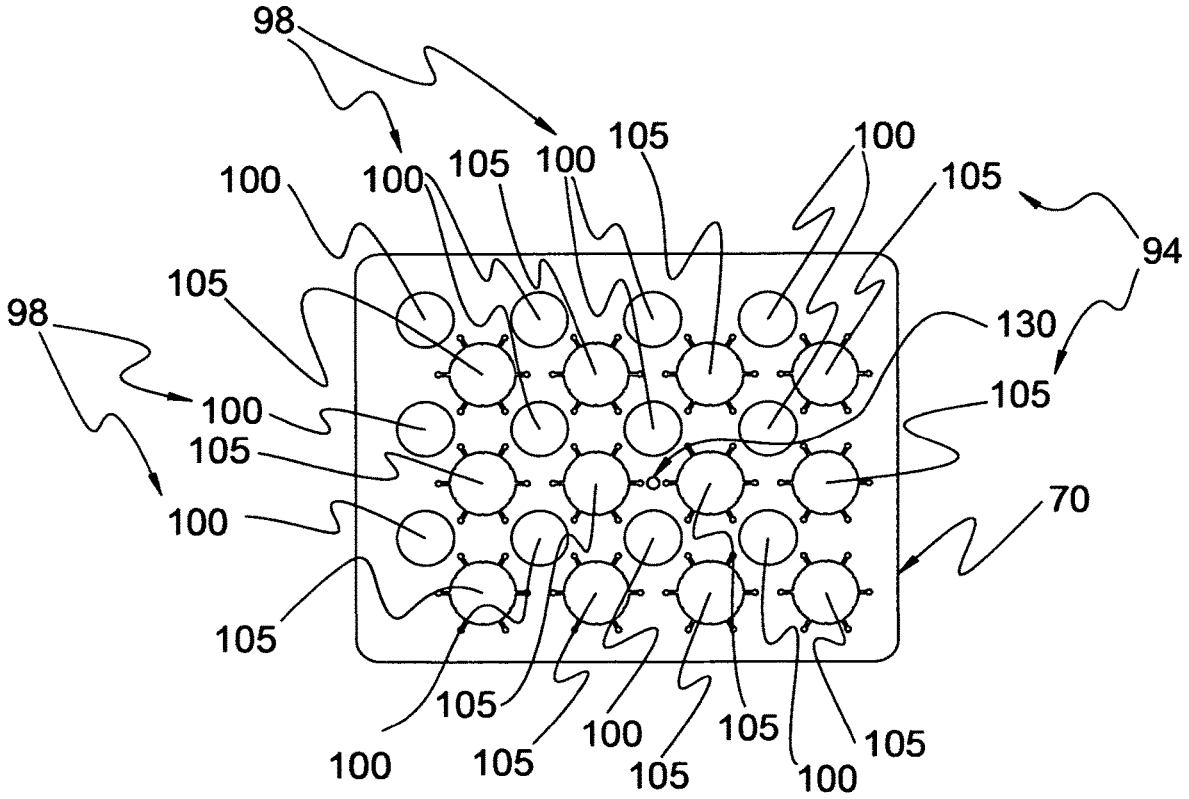
FIG. 3B is a perspective of the plate seen in FIGS. 3 and 3A with a plurality of caps disposed in holes in the plate.

As seen in FIGS. 3 and 3A, plate 70 comprises one more, small hole 130, only identified by number in FIG. 3. Small hole 130 is sized and shaped to provide a seizing interface when spout 122 is displaced therein, as seen in FIG. 5. With spout 122 so engaged, plate 70 is lifted by displacement of filter/spout assembly 40 and repositioned such that each cap 30 is set upon an associated bottle 60. In this state, each cap 30 can be affixed to each associated bottle 60 simply by cap rotation. A plate 70 filled with caps 80 is seen in FIG. 3B.

Figure 6:
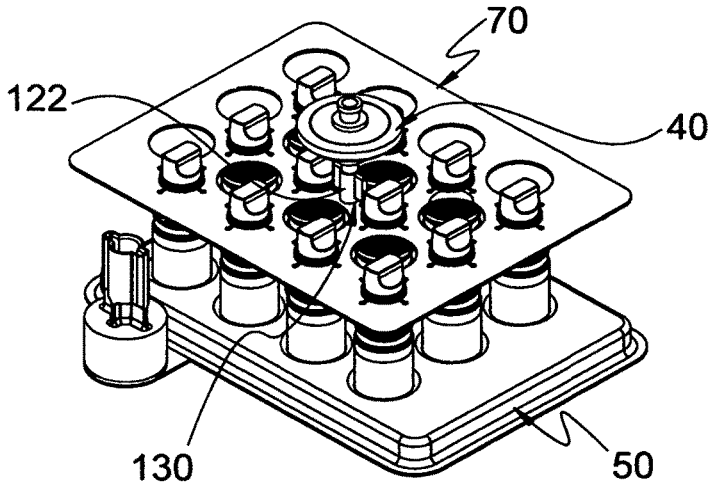
FIG. 6 is a perspective of the filled plate seen in FIG. 3B displaced via a releasible interconnection between filter spout, seen in FIG. 1, and the plate such that each cap in the plate is disposed directly above a bottle disposed in the tray as seen in FIG. 2A. (Again, the bag is not seen for clarity of presentation.)
Figure 7:
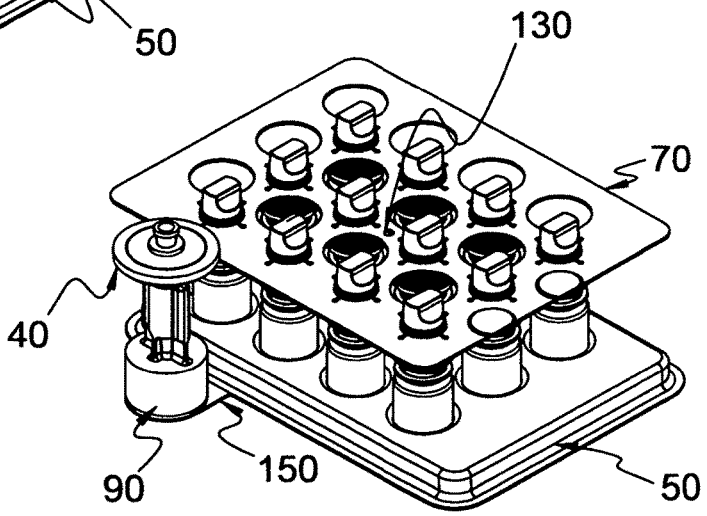
FIG. 7 is a perspective, also with the image of the bag removed, wherein the filter spout seen in FIG. 6 has been displaced into a connecting orifice of the ratchet tool seen in FIGS. 5 and 6.

In FIG. 6, (note: image of bag 30 removed for clarity), filter/spout assembly 40 is seen to be engaged in hole 130 for lifting plate 70 to displace bottle caps 80 over bottles 60. Plate 70 and caps 80 are seen to be so displaced in FIG. 7, with filter/spout assembly 40 removed from hole 30 and displaced to engagement with ratchet tool 90.

To facilitate bottle 60 capping, cap rotation, which becomes more labor intensive, as the number of bottles to be capped increases, yet another operational mode is provided by the filter/spout assembly 40. A capping ratchet tool 90, seen in FIG. 1 and, in exploded view, in FIG. 4, can be affixed, following plate 70 displacement, to filter/spout assembly 40 to facilitate bottle 60 capping.

Figure 4:
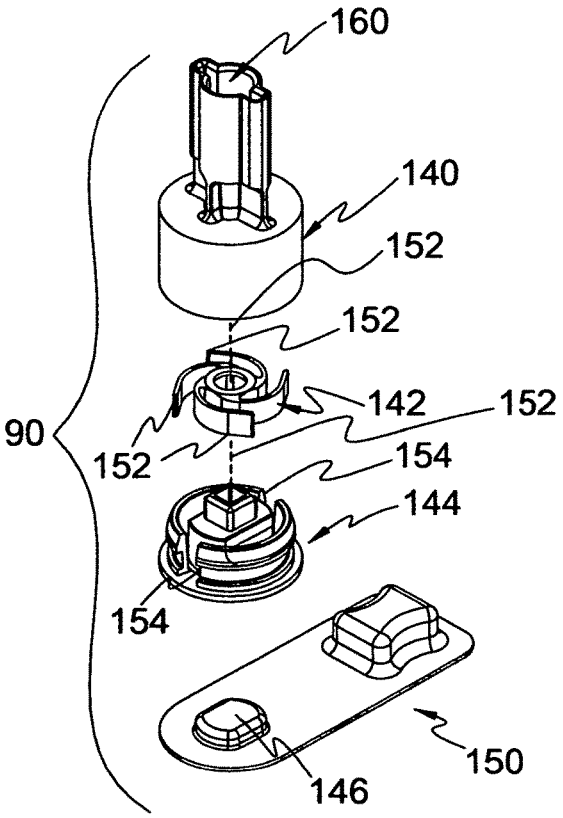
FIG. 4 is an exploded view of a ratchet assembly and a holding fixture for that assembly.

As seen in FIG. 4, tool 90 is assembled from three parts, an attachment housing 140, a leafed pawl 142 and a ratchet and cap interface 144 as indicated by dashed line 145. The interfacing portion of ratchet and cap interface 144 is not seen in FIG. 4, but one who is skilled in molding and part interfacing would well understand the necessary size and shape of such an interface. An example of a part shape to which the interface would be a hollow impression of raised part 146 seen as part of a supporting stand 150 in FIG. 4.

One who is familiar with ratchet operation would understand that arcuate leaflets 152, of pawl 142, pass freely about a ratchet pattern disposed within housing 140 (the ratchet pattern is not seen in FIG. 4, but form and structure for such are well known by those who are skilled in the art of ratchet design). While leaflets 142 pass freely when rotated in a first direction, they are obstructed by the ratchet pattern when rotated in an opposite direction. As such, when cap interface 144 is engaged with a cap 80, back and forth rotation of tool 90 rotates each associated cap 80 into secure engagement with a bottle 60. Such back and forth rotation, without removing grip at a digitally interconnecting site on the bag exterior greatly facilitates cap 80 attachment. Relief and spacing of separated rims 154 of cap interface 144 provides for ready insertion of cap interface 144 for securely retaining pawl 142 within housing 140.

To be able to use filter/spout assembly 40, in conjunction with tool 90, housing to provide facilitated bottle 60, from the exterior of bag 30, housing 140 is provided with a superiorly disposed fitting 160 having geometry 162 for engaging spout fitting 120. Once inserted, tool 90 is displaced by a bag 30 exterior part of filter/spout assembly 40 for affixing each cap 80 to a bottle 60.

As disclosed supra, part 150 provides a supporting stand for tool 80 before use. Stand 150 comprises a tray 50 interface 152 which is sized and shaped to engage tray 50 between exteriors of two wells 92 (see FIG. 2) for stability and later access.

Figure 8:
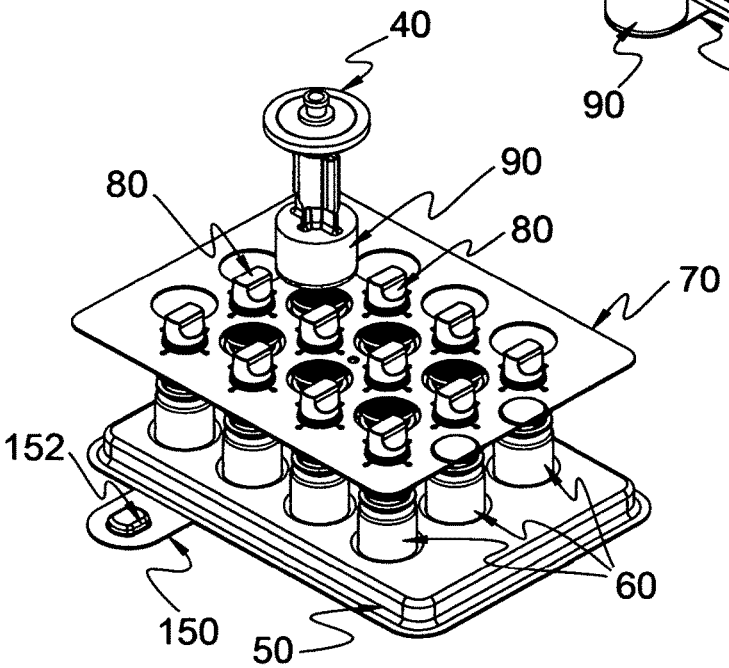
FIG. 8 is a perspective, also with the image of the bag removed, wherein the ratchet tool is disposed in contact with a cap for securely affixing the cap to an associated bottle.

As seen in FIG. 8, filter/spout assembly 40 is securely affixed to ratchet tool 90 and seen (without image of surrounding bag 30, for purposes of clarity of presentation) to be disposed in contact with a cap 80 for affixing the cap 80 to a bottle 60. Note that ratchet tool 90 has been displaced from stand 150 after engagement with assembly 40.

Figure 9:
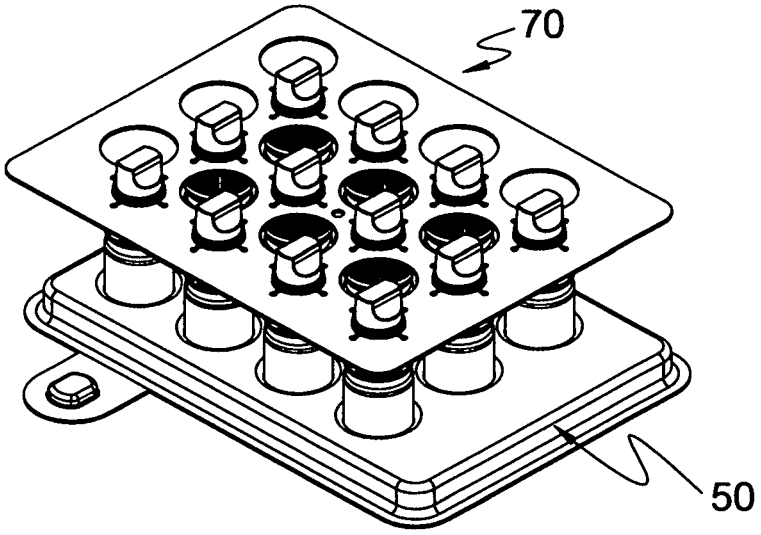
FIG. 9 is a perspective of the tray seen in FIG. 1, with capped bottles and plate removed from the bag.
Figure 10:
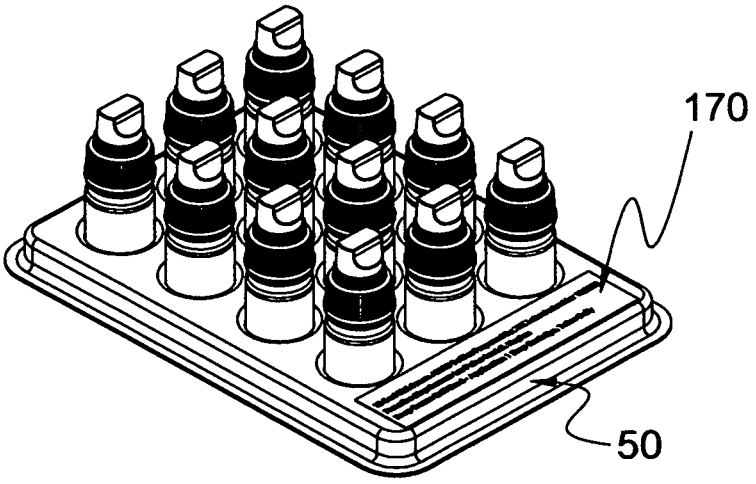
FIG. 10 is a perspective of the plate, seen in FIG. 9, removed from view such that capped bottles are disposed for product delivery. Note, a label may be affixed to the tray to provide prescription information to a user.

Once all caps 80 are securely affixed to associated bottles 60, filter/spout assembly 40 and tool 90 are displaced from use, as seen in FIG. 9. Plate 70 has no further useful function and can be removed either while within bag 30 or, thereafter, when tray and filled and capped bottles 60 are displaced from bag 30. After tray 30 and filled bottles are removed from bag 30, a label 170 bearing product information can be affixed to tray 70 as seen in FIG. 10.

Figure 12:
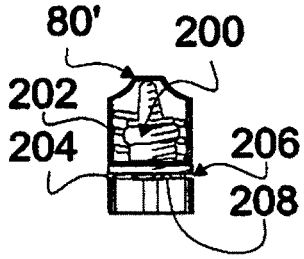
FIG. 12 is a cross section of a bottle cap which is an example of a cap inserted in to the plate seen in FIG. 11 for capping a bottle, the cap comprising a loose part.

Within the scope of the instant invention, other bottles, with different handling and filling requirements can be used. An example of a cap 80' to be affixed to a bottle type, different from bottle 60, is seen in FIG. 12. While caps 80 and 80' are affixed to a bottle in the same threaded manner, cap 80' has a loose, drop producing spout 200 disposed within a cap housing 202 of cap 80'. Such a spout 200, unless retained within housing 202, could be prone to inadvertently falling out. In addition, housing 202 comprises a frangible section 204, which separates from the rest of housing 202 when the bottle is first opened for tamper evidence. The frangible section 204 is affixed to the rest of housing 202 via a series of molded slots 206 and rods 208, which are conducive to fracture when cap is twisted from bottle at first use.

Figure 11:
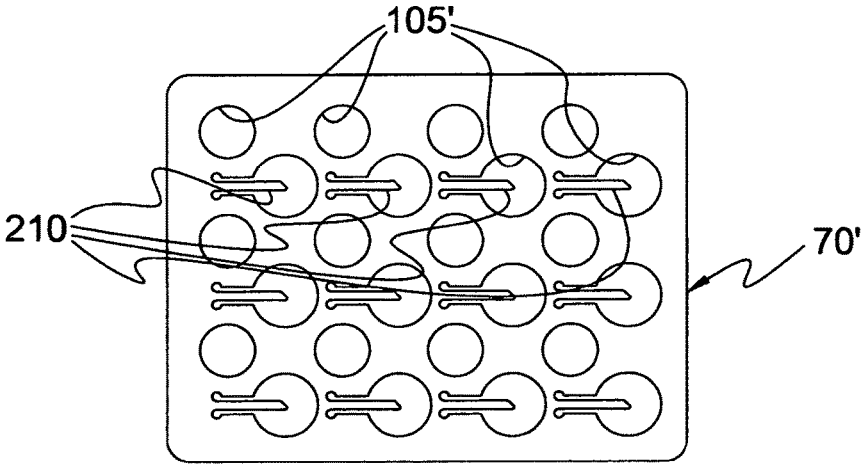
FIG. 11 is a top elevation of a plate similar to the plate seen in FIG. 3, but having a keeper disposed within each cap hole.

Reference is now made to FIG. 11 wherein a plate 70' is seen to comprise a similar pattern of holes 105' as that of holes 105 of plate 70. However, holes 105', wherein caps 60' are disposed for in bag 30 capping, have obvious differences. Each hole 105' is fitted with a keeper 210. Only a portion of holes 105' and keepers 210 are numbered in FIG. 11, but it is understood that all such holes and keepers bear similar numbers.

Figure 13:
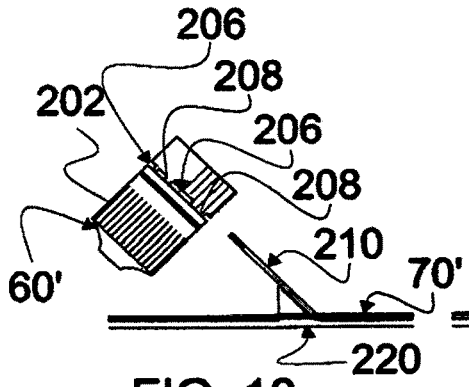
FIG. 13 is a side elevation of a cap, seen in FIG. 1, disposed above the plate, seen in FIG. 11, with a keeper upwardly displaced for insertion into a segment of the bottle, seen in FIG. 12.
Figure 14:
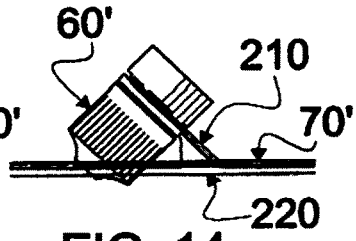
FIG. 14 is a side elevation of the keeper and cap, seen in FIG. 13, joined.
Figure 15:
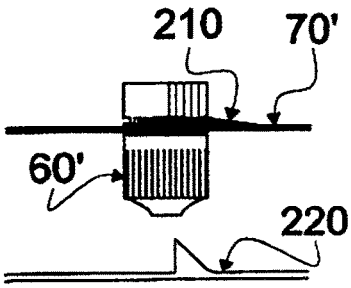
FIG. 15 is a side elevation of parts seen in FIG. 14 with the cap rotated into position for being inverted and displaced over a bottle for capping.

Each keeper 210 is sized and shaped for facile insertion through a slot 206 of an associated cap 60' TO thereby effectively retain a spout 200 in housing 202 before cap 60' is affixed to a bottle (not shown). A fixture 220 may be used to angle keeper 210 upward from plate 70' for facile insertion of keeper 210 through a slot 206 in cap 60' as seen in FIGS. 13 and 14. Once keeper 210 is so inserted, fixture 220 is displaced cap 60' may be rotated into a capping alignment as seen in FIG. 15.

Figure 16:
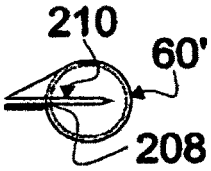
FIG. 16 is a cross section of a portion of a plate and cap with a keeper disposed for retaining the loose part within the cap.
Figure 16A:
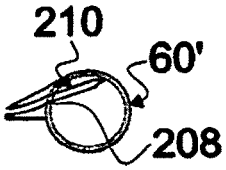
FIG. 16A is cross section of the portion of plate and cap seen in FIG. 16 rotated to displace the keeper from interfering with bottle capping.
Figure 16B:
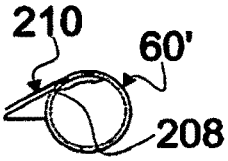
FIG. 16B is a cross section of the portion of plate and cap seen in FIG. 16A wherein further rotation further displaces the keeper.

Rotation of cap 60', when disposed for capping an associated bottle, mechanically displaces keeper from obstructive interference with capping as seen in FIGS. 16, 16A and 16B. In FIG. 16 keeper 210 is in a retentive state. In FIG. 16A, nominal rotation of Cap 60' thrusts a rod 208 against keeper 210 forcing it away from retention as seen in FIG. 16A. Further rotation displaces keeper 210 still further away from retention as seen in FIG. 16B. Still further rotation removes keeper 210 from cap 60' altogether (not shown in the FIGs).

While using filter/spout assembly 40, affixed to ratchet tool 80 facilitates capping by permitting a means for twisting the tool in sequential steps to secure a cap on a bottle, it may preferable for some users to affix the cap by a different action. Such can be provided by a linearly actuated ratchet 300, seen in FIG. 17.

Linearly actuated ratchet 300 comprises a connector 302 comprising a tapered insert 304 sized and shaped for receiving and affixing spout 122 of filter/spout assembly 40 (see FIGS. 1A and 1B). Connector 302 is a part of a rigid housing 306 which is securely affixed to an extended twisted shaft 310. Shaft 310 may be made from metal and have a stop 312 affixed inferiorly. Shaft 310 is disposed through a hole 320 in a plate 322.

An optional spring 330 is disposed between connector 302 and plate 322. Hole 320 is sized and shaped to be rotationally actuated as shaft 310 is displaced there through. Plate 322 is affixed to a body 340 which is inferiorly further affixed to a ratchet 350.

Ratchet 350 comprises ratchet parts similar to leafed pawl 142 and a ratchet and cap interface 144 (seen in FIG. 4). Thus, as linearly actuated ratchet 300 is disposed to communicate with a cap and then displaced inferiorly, the cap is rotated in a direction which affixes cap to bottle. Of course, it is intended that ratchet 300 is so displaced by digital displacement of a filter/spout assembly 40.

Figure 17:
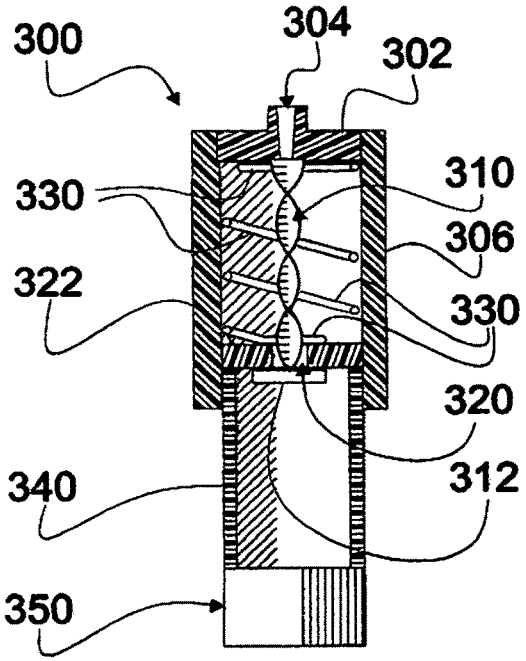
FIG. 17 is a cross section of a linearly actuated ratchet tool; use of which permits capping by displacing a portion of the tool up and down above a cap.
Figure 17A:
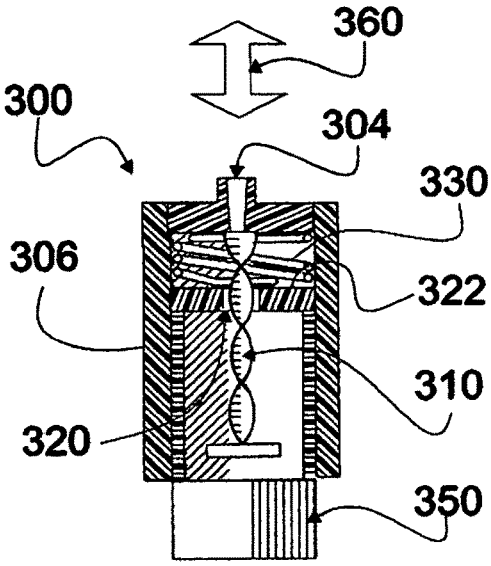
FIG. 17A is a cross section of the ratchet tool seen in FIG. 17, but, in a fully depressed state.

Note in FIG. 17A, at the completion of a first action, spring 330 is compressed to force an automatic return to the operational state seen in FIG. 17 at the end of each "pumping" cycle, as indicated by arrow 360. It may also be noted that spring 330 is optional because a user could return ratchet 300 to the state seen in FIG. 17 manually.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method for filling and capping a plurality of bottles disposed within a plastic bag comprising the following steps:

i. providing a tray comprising wells disposed in a predetermined array into which the plurality of bottles are displaced, each bottle of the plurality of bottles comprising a filling chamber disposed below an attachable neck and a superiorly disposed orifice where through each of the plurality of bottles are filled, said wells comprising sizes and shapes which firmly restrain the bottles while being filled and capped;

ii. displacing the plurality of bottles into said wells disposed in the predetermined array;

iii. providing a plate comprising a first pattern of holes, said first pattern of holes comprising hole displacement and number which are suitable and fittingly disposed for interfacing with said wells disposed in the predetermined array and the plurality of bottles, disposed in the wells disposed in the predetermined array, such that when caps are disposed within said first pattern of holes and aligned with bottles disposed in the predetermined array, the caps are, thereby, aligned for capping bottles disposed in the predetermined array, each of said first pattern of holes comprising a size and shape which retains each cap in a predetermined orientation for being affixed to one of the bottles;

iv. displacing a number of caps into the holes of said first pattern of holes, such that cap displacement in number and disposition matches number and displacement of the bottles in the predetermined array thereby providing the caps being disposed for alignment with the bottles disposed in the predetermined array;

v. providing the plastic bag into which said tray and said plate are inserted and protected by closing and sealing the plastic bag;

vi. providing a filter/spout assembly and affixing said filter/spout assembly to the plastic bag to provide the only entry pathway for fluid to be displaced into the plastic bag after being closed and sealed, said filter/spout assembly comprising a filter by which fluid displaced there through is filtered to a predetermined sterilization level and a spout through which fluid is delivered into the bottles;

viii displacing said tray with the plurality of bottles and said plate with the caps into the plastic bag, sealing the plastic bag and sterilizing the plastic bag and contents therein;

viii. using said filter/spout assembly, filling the bottles with fluid displaced through said open orifices and sterilizing the fluid thereby;

ix. displacing said plate in a single step such that all of the caps are disposed for capping, by being displaced into close relation and into alignment with said open orifices; and x. securing each of the caps to close each of the plurality of bottles before the plastic bag is breached for displacement of the plurality of so filled and capped bottles into an uncontrolled and potentially unsterile environment.

2. The method for filling and capping according to claim 1 wherein said plate providing step comprises providing said plate with another hole sized and shaped for introduction and securely, but releasably affixing said plate to said filter/spout assembly spout and said plate displacing step comprises displacing both the filter/spout assembly and the joined plate to displace the caps into alignment with the bottle orifices.

3. The method for filling and capping according to claim 1 comprising a bottles and caps providing step comprising providing said bottles and said caps with corresponding threaded attachment connecting interfaces and said tray providing step further comprising providing a ratchet tool which enables and facilitates affixing each of the caps to one of the bottles via constant digital contact from outside the bag exterior.

4. The method according to claim 3 comprising a step of providing an interface between said ratchet tool and said filter/spout assembly for digitally rotating said filter/spout assembly to affix each of the caps to one of the bottles via said ratchet tool.

5. The method for filling and capping according to claim 3 wherein said ratchet tool providing step comprises providing said tray with a connecting fitting whereat said ratchet tool is releasably affixed for interconnection to said filter/spout assembly.

6. The method according to claim 4 wherein said ratchet tool providing step comprises providing a ratchet tool which is linearly actuated for linearly displacing the spout/filter assembly to thereby thread each of the caps upon each of the bottles.

7. The method according to claim 1 wherein the plate providing step comprises providing the plate further comprising a second pattern of holes, said second pattern being an array that corresponds with said array of wells in the tray and being interspersed between holes of the first pattern, said second pattern comprising holes which are sized and shaped such that each of the holes in the second pattern can be freely displaced about the bottles, with the caps in the first hole pattern being disposed there between such that displacing the plate comprising a second pattern of holes about the bottles provides for displacing caps over bottles via a step requiring a displacement of the plate that is shorter than the maximum lateral distance between adjacent holes in the tray.

8. The method according to claim 1 wherein the plastic bag with said contents, disposed and sealed inside the plastic bag are sterilized before use such that, due to the sterilization of the matter dispensed into the plastic bag by being passed through the filter/spout assembly, the contents of the plastic bag remain in a sterile state until the plastic bag is opened to access to the contents.

* * * * *